US008234963B2

(12) United States Patent
Lee

(10) Patent No.: US 8,234,963 B2
(45) Date of Patent: Aug. 7, 2012

(54) SYSTEM AND METHOD FOR MOUNTING DIES ON A PRESS

(75) Inventor: Richard J. Lee, Hartford, WI (US)

(73) Assignee: Lee Precision, Inc., Hartford, WI (US)

( * ) Notice: Subject to any disclaimer, the term of this patent is extended or adjusted under 35 U.S.C. 154(b) by 0 days.

(21) Appl. No.: 12/228,465

(22) Filed: Aug. 13, 2008

(65) Prior Publication Data

US 2010/0037758 A1 Feb. 18, 2010

Related U.S. Application Data

(60) Provisional application No. 60/993,926, filed on Sep. 14, 2007.

(51) Int. Cl.
*F42B 33/00* (2006.01)

(52) U.S. Cl. ..... 86/23

(58) Field of Classification Search ..... 86/23, 24; 411/59, 418, 417, 549, 550, 349
See application file for complete search history.

(56) References Cited

U.S. PATENT DOCUMENTS

| | | | | |
|---|---|---|---|---|
| 763,210 | A * | 6/1904 | Schwamberger et al. | 285/355 |
| 796,220 | A | 8/1905 | Jones | |
| 2,673,751 | A * | 3/1954 | Finch | 285/84 |
| 2,700,560 | A | 1/1955 | Hansen | |
| 3,442,536 | A * | 5/1969 | Fowler | 285/27 |
| 3,948,545 | A * | 4/1976 | Bonds | 285/4 |
| 4,278,005 | A * | 7/1981 | Lachner et al. | 411/337 |
| 4,406,485 | A * | 9/1983 | Giebeler | 285/391 |
| 4,869,148 | A * | 9/1989 | Tucker | 86/43 |
| 5,403,043 | A * | 4/1995 | Smet | 285/39 |
| 5,932,828 | A | 8/1999 | Hornady | |
| 6,283,511 | B1 * | 9/2001 | Kamp | 285/391 |
| 6,481,916 | B1 | 11/2002 | Hornady | |
| 2007/0022870 | A1 * | 2/2007 | Bond et al. | 86/24 |

OTHER PUBLICATIONS

Author Unknown, "Belemont Quick-Change Inserts" product information from 1964 Handloader's Digest, p. 141. Copy attached.

* cited by examiner

*Primary Examiner* — Michael Carone
*Assistant Examiner* — Reginald Tillman, Jr.
(74) *Attorney, Agent, or Firm* — Philip J. Lee

(57) ABSTRACT

A system and method for rapidly and easily installing and removing ammunition reloading dies into and from an ammunition reloading press uses an adapter with a female threaded socket to receive a conventionally threaded die and sections of male screw threads arrayed around the exterior and separated by open sections corresponding to sections of female screw threads formed in a socket in the press, the adapter threads engageable with the press socket threads to secure the adapter within the press socket with less than a full rotation of the adapter, open sections in the press socket allow the adapter to enter the socket to nearly full depth without rotation.

9 Claims, 2 Drawing Sheets

SYSTEM AND METHOD FOR MOUNTING DIES ON A PRESS

CROSS REFERENCE TO RELATED PROVISIONAL APPLICATION

This application claims the benefit of U.S. Provisional Application No. 60/993,926, filed Sep. 14, 2007.

BACKGROUND OF THE INVENTION

A. Field of Invention

The present invention relates generally to devices used in ammunition loading or reloading and more particularly to a new and improved die adapter and press system for quickly mounting and removing reloading dies in a press.

B. Description of Related Art

In the reloading of used ammunition cartridges, the usual system involves use of a press with a mounting plate on which one or more dies are mounted. Multiple operations are required to complete the reloading process and a variety of dies are used in the course of performing the required operations. Each die comprises a tool portion for performing a specific action and a means for mounting the die on the press. Operation of the press causes the die and the cartridge to move relative to each other such that the tool portion of the die can perform its task. Frequently the die remains stationary in the press while a ram arm moves the cartridge toward, into and away from the die. Operation of a reloading press generally requires a forceful engagement by the tool and therefore the die must be securely mounted in the press. A frequently used method of securing the dies on the press involves screw threads, male threads on the die and female threads in the press. Dies that are threaded into a reloading press with ⅞-14 threads have become the accepted standard throughout the industry. Often, two to four dies are required for the operations and are specific for each caliber of ammunition to be reloaded. Changing the dies for the various operations is time consuming as each die must be screwed in and out and inch or more and the depth of threading insertion is critical. A device to quickly change reloading dies is described in U.S. Pat. Nos. 5,932,828 and 6,481,916 to Hornady, which devices require a two part adapter system, a male threaded piece to be screwed into the press and a female threaded piece to receive the die. Such devices are relatively cumbersome to use and require joining of four parts, increasing the probability of unstable or loose mounting of the die.

It would therefore be desirable to provide a device that is inexpensive to manufacture and capable of quickly and securely mounting a conventional ammunition reloading die to a press adapted to receive said device.

SUMMARY OF THE INVENTION

The device of the present invention comprises a specifically designed press with a socket that is adapted to receive an adapter for mounting a conventionally threaded die. The adapter further comprises female threads sized and pitched to receive the customarily male threaded reloading die. The press socket comprises a plurality of sections of female screw threads that are axially stacked. The socket thread sections are symmetrically arrayed around the inside wall of the press socket and circumferentially separated from each other by a like number of open sections, the socket threaded sections having a lesser inside diameter than the socket open sections. The sections of threads are identical with each other and do not form a continuous screw thread into which a normally threaded male part could be screwed. The adapter is generally of an approximately cylindrical shape and comprises the same number of sections of male screw threads as the press socket has female thread sections. The adapter male threads in each section are axially stacked and identical, corresponding to the socket threads and similarly are not continuous. The male thread sections are symmetrically arrayed around the outside wall of the adapter and are circumferentially separated from each other by a like number of open sections, the adapter threaded sections having a larger outside diameter than the adapter open sections. The inside diameter of the press socket open sections is slightly greater than the outside dimension of the male screw threads of the adapter, and the outside diameter of the adapter open sections is slightly less than the inside diameter of the female screw thread sections of the press socket. The adapter threaded sections are the same or slightly less in circumferential dimension as the socket open sections and the socket threaded sections are the same or slightly less in circumferential dimension as the adapter open sections. The male threaded sections of the adapter and the female threaded sections of the press socket are sized and pitched to be engageable with each other. The adapter can be inserted directly into the socket without rotation to a depth where the corresponding threads can engage. The adapter further comprises an outwardly extending collar, which forms a shoulder at the outer or upper end of the adapter. The sizing of the adapter allows the adapter to be inserted into the press opening to an initial position, close to the final depth. Partial rotation of the adapter then causes engagement of the respective screw threads of the adapter with those of the press socket, causing the adapter to be securely advanced into the press socket until the upper rim of the press socket engages the adapter shoulder and the adapter reaches its final position. An elastomeric "O" ring is located in the bottom of the press socket and held in place by a shoulder at a depth such that the bottom edge of the adapter rests against the "O" ring when the corresponding threads of the adapter and socket are aligned and about to be engaged. Rotation of the adapter relative to the socket engages the threads and advances the adapter into the socket and increases the force to the adapter against the "O" ring, compressing it between the adapter bottom edge and the socket shoulder. The compression of the "O" ring results in friction, helping the secure the adapter against unwanted counter rotation and loosening during operation of the press. The adapter collar is notched and a spring actuated retractable locking pin is mounted on the press in a position to engage the adapter notch when the adapter is fully inserted and rotated to a locked position and prevent rotation of the adapter relative to the press unless the locking pin is retracted.

A conventionally threaded reloading die is threaded into the adapter to the desired depth and locked in place by a lock ring. Providing an adapter on each conventionally threaded die to be used results in easier changing of the dies The threaded sections of the opening and adapter could be made with a standard, continuous thread, which would require the adapter to be oriented to a single position when inserted into the press opening. The preferred embodiment uses multiple sets of thread, each being identical such that each section has thread starts and each of the adapter thread sections could engage any of the female thread sections in the press socket. Therefore, the adapter may be inserted into the socket in as many different orientations as there are thread sections on the adapter. The system will work well with almost any number of thread segments, however 3 sections is preferred for self centering, ease of machining and maximum engagement.

It has been found that designing the lead of the threaded sections to be greater than the lead of the conventional die threads causes the die to tighten more securely with the adapter than the adapter with the press. Thus, removing the die by turning the die will leave the adapter in place on the die. An important feature of the adapter is the ease of manufacture. It can be machined from bar stock, powdered metal, die cast, injection or compression molded.

The principle aim of the present invention is to provide a new and improved device means for quickly and easily installing conventionally threaded dies on a reloading press that is economical to manufacture and use.

Other objects and advantages of the invention will become apparent from the Description of the Preferred Embodiments and the Drawings and will be in part pointed out in more detail hereinafter.

The invention consists in the features of construction, combination of elements and arrangement of parts exemplified in the construction hereinafter described and the scope of the invention will be indicated in the appended claims.

DESCRIPTION OF THE PREFERRED EMBODIMENT(S)

Figure 1:
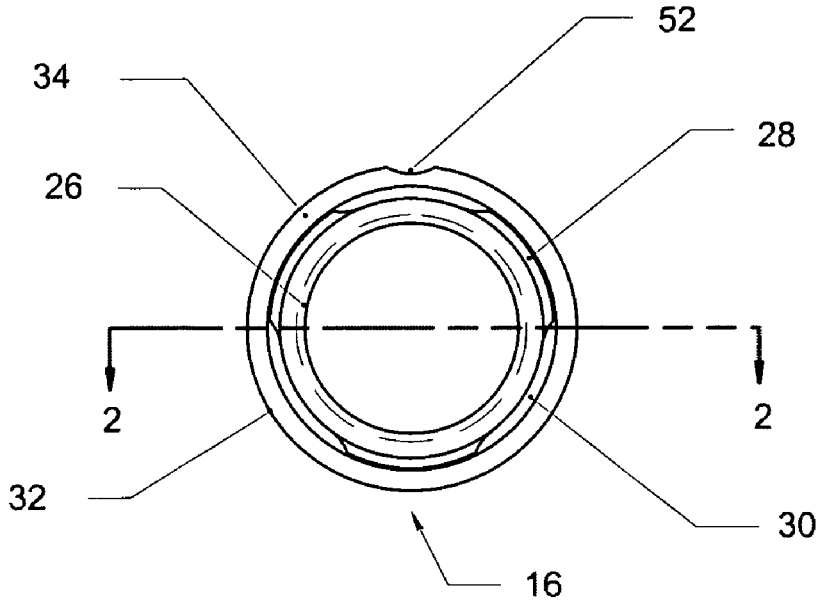
FIG. 1 is a bottom, end view of an adapter of the present invention.
Figure 2:
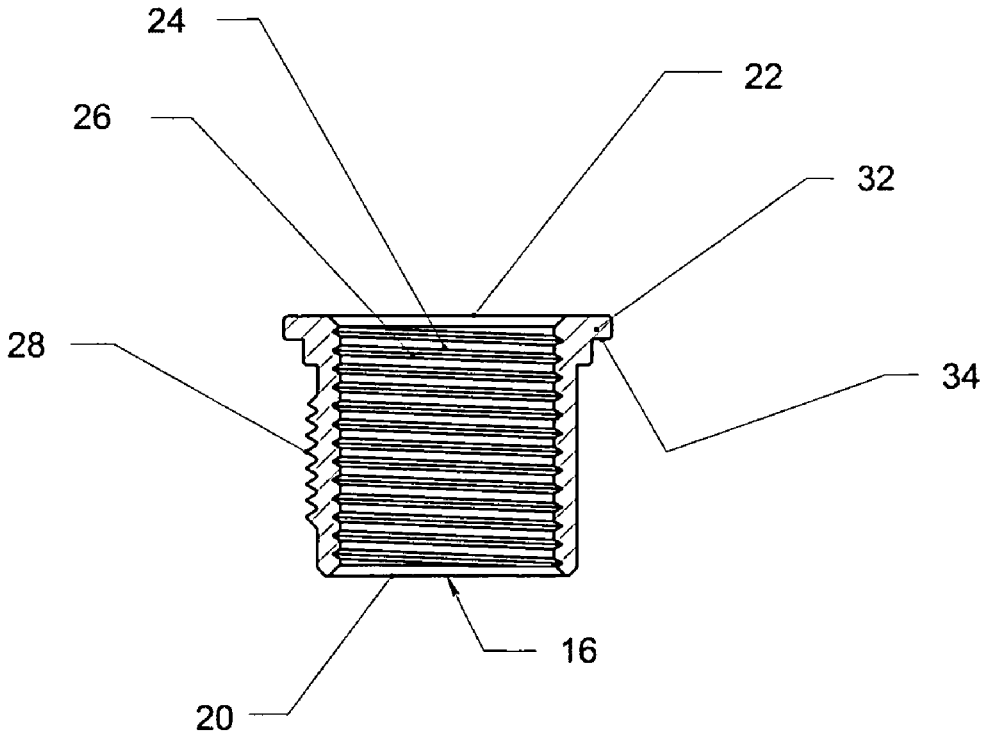
FIG. 2 is a cross-sectional side view of an adapter of the present invention.
Figure 3:
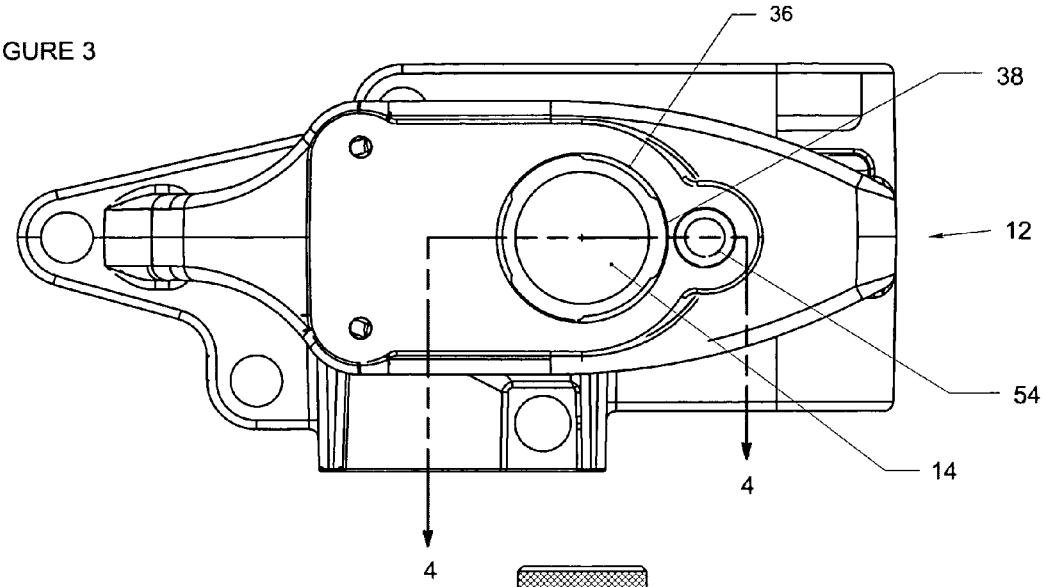
FIG. 3 is a top view of an ammunition reloading press with a socket in accord with the present invention.
Figure 4:
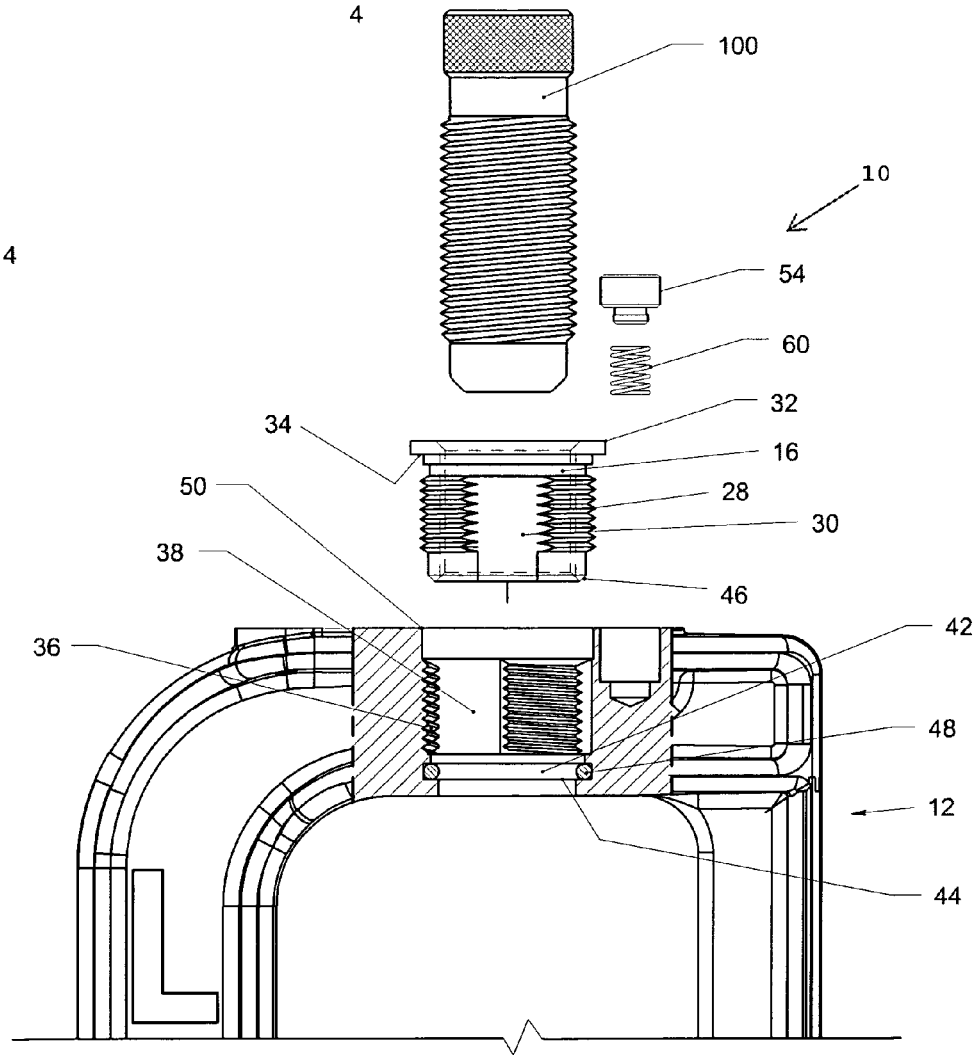
FIG. 4 is side view of the components of a system in accord with the present invention with a partial cross sectional view of a press socket taken along line 4-4 shown in FIG. 3.

With reference to the Drawings wherein like numerals represent like parts throughout the Figures, a system for installing an ammunition reloading dies in accord with the present invention for is generally designated by numeral 10 in FIG. 4. System 10 comprises an ammunition reloading press 12 with a socket 14 that is adapted to receive an adapter 16 for mounting a conventionally male threaded die, an example of which is shown in FIG. 4 and designated by the numeral 100. Reloading press 12 has features of conventional reloading presses, such as means for securing the press to a work bench or other support and ram means for forcibly advancing an ammunition cartridge toward and away from a die 100 secured within the press socket 14, which conventional features are not shown.

Adapter 16 is generally cylindrical in shape with a bottom end 20 and an upper end 22, so described in accord with the usual orientation of the components in use. A central, internal socket 24 is formed within adapter 16 and extending through the adapter 16. The inner wall of adapter socket 24 is formed with female screw threads 26, that are sized and pitched to receive the customarily male threaded reloading die 100. The exterior wall of adapter 16 comprises a plurality of sections 28 of male screw threads that are axially stacked and are raised radially outward above open sections 30 of the external wall of adapter 16. In the illustrated preferred embodiment, adapter 16 has three male thread sections 28 and three open sections 30 that are alternatingly arrayed circumferentially around the exterior wall of adapter 16 in a symmetric manner. Each male thread section extends the same arc distance throughout the section. It will be appreciated and anticipated that as few as one screw thread could make up a threaded section 16, but as illustrated, multiple screw threads are expected to provide additional strength and stability. Similarly, while any number of male thread sections 28 could be used, three sections 16 are shown and preferred for self centering, ease of machining and maximum engagement. The outside diameter of adapter 16 at the male threaded sections 16 exceeds the diameter at the open sections 30 by at least the depth of the threads. The screw threads in each male screw thread section 28 are identical to the screw threads on each other section 28 and therefore do not form a continuous screw thread and adapter 28 cannot be screwed into a conventional female thread. Adapter upper end further comprises an outwardly extending collar 32, which forms a downward facing shoulder 34.

Press socket 14 is formed as a generally cylindrical bore through the upper, die mounting area of a press 12 and the inside wall of press socket 14 is formed with a plurality of sections 36 of axially stacked female screw threads. Socket thread sections 36 are symmetrically arrayed around the inside wall of the press socket and circumferentially separated from each other by a like number of open sections 38. The inside diameter of press socket 14 at the open sections 38 is greater than the diameter at the socket threaded sections 36 by at least the depth of the threads. The female screw threads of each section 36 are identical with those of each other section 36 and do not form a continuous screw thread into which a normally threaded male part could be screwed. The depth, pitch and lead of the female screw threads of press socket 14 correspond to the male screw threads of adapter 16 and any of the male threaded sections 28 of the adapter 16 is engageable with any one of the female threaded sections 36 of the press socket 14. The inside diameter of the press socket open sections 38 is slightly greater than the outside diameter of the male screw thread sections 28 of adapter 16, and the outside diameter of the adapter open sections 30 is slightly less than the inside diameter of the female screw thread sections 36 of the press socket 14, all by only so much clearance as is required to allow adapter 16 to be inserted into press socket 14 and to allow the male screw threads to engage the female screw threads. For the same reason the adapter male threaded sections 28 are the same or slightly less in circumferential dimension as the socket open sections 38 and the socket threaded sections 36 are the same or slightly less in circumferential dimension as the adapter open sections 30. The adapter threaded sections 28 and the press socket threaded sections 36 has the same number of screw threads.

An annular ring 48 is formed of an elastomeric substance and retained in an annular groove 42 toward the bottom end 44 of press socket 14 and sized to protrude into the interior of socket 14. The outer edge 46 of adapter bottom end 20 is chamfered and sized to contact ring 48 when adapter 16 is inserted into press socket 14. The threaded sections 28 of adapter 16 are axially located relative to the adapter bottom end 20 at approximately the same distance as the threaded sections 36 of the press socket 14 are axially located relative to ring 48 such that the bottom edge 46 of the adapter 16 rests against ring 48 when the corresponding threads of the adapter 16 and socket 14 are aligned and ready to be engaged. The length of adapter 16 is sufficient that adapter shoulder 34 does not contact the top surface of press 12 when adapter 16 is initially inserted into press socket 14. After initial insertion of adapter 16 into press socket 14, partial rotation of adapter 16 then causes engagement of the respective screw threads of the adapter 16 with those of the press socket 14, causing adapter 16 to be securely advanced into the press socket. Before adapter 16 is rotated more than the arc angle of the threaded sections 28 and 36, the upper rim 50 of the press socket 14 engages the adapter shoulder 34 and adapter 16 reaches its final position. Advancement of adapter 16 into press socket 14 increases the contact force of the adapter bottom end 20 against ring 48, compressing ring 48 between the adapter bottom edge 46 and the socket groove 42. The compression of ring 48 results in friction, helping the secure adapter 16 against unwanted counter rotation and loosening during operation of the press 12. A notch 52 is formed in the radially outer edge of adapter collar 32 and a locking pin 54 is retractably engageable with notch 52 when adapter 16 is fully inserted and rotated to its desired locked position. Locking pin 54 is mounted on the top surface of press 12 within a bore sized for that purpose and is biased upward toward the locking position of engagement with notch 52 by a spring 60. Pin 54 can be depressed, compressing spring 60, disengaging pin 54 from notch 52 and unlocking adapter 16. Although the figures show a single locking pin 54, it will be anticipated that multiple locking pins 54 and/or notches 52 could be provided, up to the number of threaded sections.

The method of the present invention includes the fabrication of press 12 with socket 14 as well as adapter 16, which can be fabricated from thermo plastic or thermo set plastics, or machined from bar stock, powdered metal, die cast, injection or compression molded. A conventionally threaded reloading die 100 is screwed into the adapter female threads 26 to the desired depth and may be locked in place by a lock ring (not shown). The die with adapter combination can then be quickly mounted on press 12 by an insertion into socket 14 until adapter end 20 contacts ring 48 and subsequent rotation of adapter 16 into final locked position. Removal of the die and adapter combination from press 12 is a reversal of the installation process, preceded if necessary, by disengagement of locking pin 54 from adapter collar notch 52. The operator has the choice of orienting adapter 16 in press socket 14 so as to engage the locking pin 54 or to not engage locking pin 54, in which case the removal step is simplified by eliminating the requirement of depressing locking pin 54 while counter rotating adapter 16.

It will be anticipated that the threaded sections 28 and 36 of the adapter 16 and press socket 14 could be made alternatively with a standard, continuous thread, although such threading would require adapter 16 to be oriented to a single position when inserted into the press socket 14. It will be further anticipated that while the preferred embodiment uses three sets of threads, the system will work well with almost any number of thread segments. It has been found that designing the lead of the threaded sections to be greater than the lead of the conventional die threads causes the die to tighten more securely with the adapter than the adapter with the press. Thus, removing the die by turning the die will leave the adapter in place on the die.

It will be further anticipated that other means of register are anticipated such as flared thread ends on either or both parts. Further, an alternate design of the adapter would be to lengthen the adapter collar 32, axially cut through the collar and drill a cross bolt hole to allow collar 32 to be clamped to die 100, thereby eliminating the need for lock ring 62.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and the scope of the present invention. It is specifically anticipated a variety of materials could be suitable for use in constructing the components of system 10 without departing from the spirit of this invention.

What is claimed is:

1. A system for installing and removing male threaded ammunition reloading dies to and from an ammunition reloading press, the system comprising an adapter having an internally threaded central bore and a generally cylindrical outer surface extending from a top end to a bottom end with a number of at least two equally spaced threaded sections of axially stacked columns of a plurality of equally axially spaced external screw thread segments of equal arc length, the adapter threaded sections being circumferentially separated by open sections, each adapter threaded section having the same number of screw thread segments with the same axial separation between the screw thread segments, each of which has the same angle of slope and the screw thread segments of each threaded section are started at the same distance from the adapter top end, and a press, the press having formed therein a socket having a generally cylindrical inner surface extending from a top end to a bottom end with the same number of equally spaced threaded sections of axially stacked columns of equally axially spaced internal screw thread segments of equal arc length corresponding to and engageable with the adapter thread segments, being the same in number as the adapter thread segments, with the same axial separation between the screw thread segments, which have the same angle of slope and start, the press socket threaded sections being circumferentially separated by open sections having a diameter and arc length equal to or greater than the diameter and arc length of the adapter threaded sections and the adapter open sections having a diameter equal to or less than the diameter of the press socket threaded sections.

2. The system in accord with claim 1, wherein the adapter comprises three threaded sections and the press socket comprises three threaded sections.

3. The system in accord with claim 2, wherein the adapter threaded sections extend across an arc of approximately 60 degrees.

4. The system in accord with claim 3, wherein adapter top end comprises a shoulder placed to abut the press when the adapter threads are fully engaged with the press socket threads.

5. The system in accord with claim 4, wherein press socket further comprises an annular groove adjacent to the bottom end of the press socket and an elastomeric annulus retained partially within the groove approximately the same distance from the press socket threads as the distance from the bottom end of the adapter to the adapter threads, such that when the adapter bottom end initially contacts the elastomeric annulus within the press socket, the threads of the adapter align with the press socket threads, and the annulus is axially compressible by an amount equal to the axial separation between the adapter shoulder and the press.

6. A method of installing and removing male threaded ammunition reloading dies to and from an ammunition reloading press, the method comprising formation of a die adapter having an internally threaded central bore and a generally cylindrical outer surface extending from a top end to a bottom end with a number of at least two equally spaced threaded sections each comprising a column of equally spaced axially stacked external screw thread segments of equal arc length, each adapter threaded section having the same number of external screw thread segments, with the same angle of slope that are started at the same distance from the adapter top end, and forming a socket in an ammunition reloading press, the socket having a generally cylindrical inner surface extending from a top end to a bottom end with an equal number at least two equally spaced threaded sections each comprising a column of equally spaced axially stacked internal screw thread segments of equal arc length corresponding to and engageable with the adapter threads, each press socket threaded section having the same number of internal screw thread segments as the adapter threaded sections and all threaded segments have the same axial separation, angle of slope and start, forming open sections on the adapter surface and the press socket that circumferentially separate the threaded sections on the adapter and on the press socket, the press socket open sections having a diameter and arc length equal to or greater than the diameter and arc length of the adapter threaded sections, and the adapter open sections having a diameter equal to or less than the diameter of the press socket threaded sections, threading the die into the adapter central bore, inserting the adapter with die into the press socket, rotating the adapter to engage the threads of the press socket and the adapter, and counter rotating the die after use to disengage the press socket threads and adapter threads after use, and removing the die and adapter.

7. The method in accord with claim 6, wherein formation of the adapter comprises forming three threaded sections and forming the press socket comprises forming three threaded sections, with each threaded section extending across an arc of approximately 60 degrees.

8. The method in accord with claim 7, further comprising forming a shoulder at the adapter top end placed to abut the press when the adapter threads are fully engaged with the press socket threads, and further comprises forming an annular groove adjacent to the bottom end of the press socket and placing an elastomeric annulus partially within the groove at approximately the same distance from the press socket threads as the distance from the bottom end of the adapter to the adapter threads, such that when the adapter bottom end contacts the elastomeric annulus within the press socket, the threads of the adapter aligns with the press socket threads.

9. The method in accord with claim 8, wherein threading of the adapter into the press socket further comprises formation of the adapter comprises rotating the adapter until the adapter threaded sections align with the press socket open sections, inserting the adapter into the press socket without rotation until the adapter bottom end contacts the elastomeric annulus and the adapter threads align with the press socket threads, and then rotating the adapter until the adapter shoulder securely contacts the press surface.

* * * * *